US011396313B2

(12) United States Patent
Yanai et al.

(10) Patent No.: US 11,396,313 B2
(45) Date of Patent: Jul. 26, 2022

(54) TRAFFIC SYSTEM, CONTROL METHOD, AND PROGRAM

(71) Applicant: Mitsubishi Heavy Industries Engineering, Ltd., Yokohama (JP)

(72) Inventors: Noritaka Yanai, Tokyo (JP); Yutaka Miyajima, Tokyo (JP)

(73) Assignee: MITSUBISHI HEAVY INDUSTRIES ENGINEERING, LTD., Kanagawa (JP)

( * ) Notice: Subject to any disclaimer, the term of this patent is extended or adjusted under 35 U.S.C. 154(b) by 0 days.

(21) Appl. No.: 15/112,320

(22) PCT Filed: Oct. 27, 2014

(86) PCT No.: PCT/JP2014/078489
§ 371 (c)(1),
(2) Date: Jul. 18, 2016

(87) PCT Pub. No.: WO2015/111268
PCT Pub. Date: Jul. 30, 2015

(65) Prior Publication Data

US 2016/0332647 A1 Nov. 17, 2016

(30) Foreign Application Priority Data

Jan. 23, 2014 (JP) ..... JP2014-010399

(51) Int. Cl.
*B61L 27/04* (2006.01)
*B61L 3/00* (2006.01)
(Continued)

(52) U.S. Cl.
CPC ..... *B61L 27/04* (2013.01); *B61L 3/008* (2013.01); *B61L 3/121* (2013.01); *B61L 23/00* (2013.01);
(Continued)

(58) Field of Classification Search
CPC ..... B61L 27/04; B61L 27/0038; B61L 23/00; B61L 23/14; B61L 25/025; B61L 25/021; B61L 3/008; B61L 3/121; B61L 2201/00
See application file for complete search history.

(56) References Cited

U.S. PATENT DOCUMENTS 1,584,224 A * 5/1926 Howe ..... B61L 3/121 246/182 R
3,606,490 A * 9/1971 Noriyoshi ..... B60T 8/17633 188/181 A
(Continued)

FOREIGN PATENT DOCUMENTS

JP S62-007308 A 1/1987
JP H08-140219 A 5/1996
(Continued)

OTHER PUBLICATIONS

PCT/ISA/210, "International Search Report for International Application No. PCT/JP2014/078489," dated Jan. 27, 2015.
(Continued)

*Primary Examiner* — Peter D Nolan
*Assistant Examiner* — Michael F Whalen
(74) *Attorney, Agent, or Firm* — Kanesaka Berner and Partners LLP

(57) ABSTRACT

The limit information acquisition unit is configured to acquire limit information including speed limit information and the position information corresponding to the speed limit, from a vehicle speed limit unit that is configured to set the speed limits at a plurality of positions in order to achieve a predetermined deceleration completion speed at the speed limit start position. The current position acquisition unit is configured to acquire a current position of the vehicle. The current speed acquisition unit is configured to acquire a current speed of the vehicle. The travel curve generation unit is configured to generate a travel curve which satisfies the
(Continued)

speed limit at each position obtained from the limit information according to the acquired limit information, the current position, and the current speed. The speed command unit is configured to generate a speed command according to the generated travel curve and the current position.

6 Claims, 7 Drawing Sheets

(51) Int. Cl.
*B61L 25/02* (2006.01)
*B61L 3/12* (2006.01)
*B61L 27/20* (2022.01)
*B61L 23/00* (2006.01)

(52) U.S. Cl.
CPC ..... *B61L 25/021* (2013.01); *B61L 25/025* (2013.01); *B61L 27/20* (2022.01); *B61L 2201/00* (2013.01)

(56) References Cited

U.S. PATENT DOCUMENTS 4,302,811 A * 11/1981 McElhenny ..... B61L 3/125 246/182 B
4,384,695 A * 5/1983 Nohmi ..... B61L 3/12 246/182 B
5,018,689 A * 5/1991 Yasunobu ..... B60L 15/00 246/182 B
5,332,180 A * 7/1994 Peterson ..... B61L 3/004 246/122 R
5,340,062 A * 8/1994 Heggestad ..... B61L 3/008 246/167 R
5,437,422 A * 8/1995 Newman ..... B61L 27/0038 246/5
5,467,945 A * 11/1995 Kubota ..... B61L 19/06 246/187 B
5,474,267 A * 12/1995 Kubota ..... B61L 19/06 104/292
5,947,423 A * 9/1999 Clifton ..... B61L 3/225 246/167 R
7,395,141 B1 * 7/2008 Seck ..... B61C 17/12 246/182 R
8,554,397 B1 * 10/2013 Nishinaga ..... B61L 3/008 701/19
9,387,866 B1 * 7/2016 Di Cairano ..... B61H 13/00
10,093,331 B2 * 10/2018 Danielson ..... B60W 30/146
10,308,264 B2 * 6/2019 Jung ..... B61L 3/006
2003/0093195 A1 * 5/2003 Ishikawa ..... B61L 3/125 701/19
2004/0006413 A1 * 1/2004 Kane ..... B61L 3/008 701/19
2005/0068184 A1 * 3/2005 Kane ..... B61L 15/009 340/576
2009/0125170 A1 * 5/2009 Noffsinger ..... B60L 7/16 701/20
2009/0277724 A1 * 11/2009 Thumm ..... B66B 1/34 187/393
2010/0241296 A1 * 9/2010 Rhea, Jr. ..... B60T 13/665 701/20
2012/0320875 A1 * 12/2012 Ishihara ..... B60L 15/40 370/331
2014/0032023 A1 * 1/2014 Kumar ..... B60T 17/228 701/20
2014/0209759 A1 * 7/2014 Tsukamoto ..... B61L 25/026 246/2 S
2015/0014488 A1 * 1/2015 Saito ..... B60L 3/0015 246/184
2017/0072974 A1 * 3/2017 Morita ..... B61L 27/04
2017/0080942 A1 * 3/2017 Nakada ..... B60W 50/0098
2017/0190340 A1 * 7/2017 Jung ..... B61L 3/006

FOREIGN PATENT DOCUMENTS

JP H09-076914 A 3/1997
JP H09-193805 A 7/1997
JP 2010-028926 A 2/2010
JP 2011-116212 A 6/2011
JP 2011-217564 A 10/2011
JP 2012-105438 A 5/2012
JP 2013-082240 A 5/2013
JP 2013-172475 A 9/2013

OTHER PUBLICATIONS

PCT/IPEA/409, "International Preliminary Report on Patentability for International Application No. PCT/JP2014/078489," dated Jan. 27, 2015.

* cited by examiner

TRAFFIC SYSTEM, CONTROL METHOD, AND PROGRAM

TECHNICAL FIELD

The present invention relates to a travel control device, a vehicle, a traffic system, a control method, and a program.

Priority is claimed on Japanese Patent Application No. 2014-010399, filed Jan. 23, 2014, the content of which is incorporated herein by reference.

BACKGROUND ART

In order for safe driving of a train, there is a railway system including an automatic train protection (ATP) device that automatically operates a brake when the speed of the train exceeds a predetermined speed. In addition, there is also a railway system including an automatic train operation (ATO) device for the purpose of automatic operation and an energy saving operation of the train.

Patent Document 1 describes a technology that includes both the ATP device and the ATO device and realizes automatic operation of a train that allows safely stopping and does not cause an operation delay as a related technology.

CITATION LIST

Patent Document

[Patent Document 1] Japanese Unexamined Patent Application, First Publication No. 2010-28926

SUMMARY OF INVENTION

Technical Problem

Incidentally, in a railway system, each of ATP and ATO has independent functions and thus, an ATP device and an ATO device are usually separate from each other as hardware devices. Therefore, a railway system including both an ATP device and an ATO device is designed to have a margin which is a sum of a maximum value of a recognition position error of the ATP device and a maximum value of a recognition position error of the ATO device. In addition, since each of the ATP device and the ATO device calculates positions, even in the railway system the railway system using the technology described in Patent Document 1, the railway system is designed to have a margin which is a sum of each of the maximum values of the recognition position errors. As a result thereof, when automatic driving is performed on a vehicle, the margin cannot be smaller than the sum of the maximum values of the recognition position errors, and thus, there is a possibility that the travelling time of the train with respect to a travelling distance may increase.

The present invention provides a travel control device, a vehicle, a traffic system, a control method, and a program that can reduce the travelling time of the train with respect to the travelling distance when automatic driving is performed on the vehicle using the travel control device.

Solution to Problem

According to a first aspect of the present invention, a travel control device is mounted on a vehicle and sets a travel speed according to a position of the vehicle and causes the vehicle to travel. The travel control device includes a limit information acquisition unit, a current position acquisition unit, a current speed acquisition unit, a travel curve generation unit, and a speed command unit. The limit information acquisition unit is configured to acquire limit information which indicates a plurality of relative positions to the front position with a current position as a reference and each speed limit information at the front position indicated by each of the plurality of relative positions, from the vehicle speed limit unit that is configured to set the speed limits at a plurality of positions in order to achieve a predetermined deceleration completion speed at the speed limit start position. The current position acquisition unit is configured to acquire a current position of the vehicle. The current speed acquisition unit is configured to acquire a current speed of the vehicle. The travel curve generation unit is configured to generate a travel curve in which the speed limit at each position obtained from the limit information becomes lower than a predetermined speed, according to the acquired limit information, the current position, and the current speed. The speed command unit is configured to generate a speed command according to the generated travel curve and the current position.

According to a second aspect of the present invention, the limit information acquisition unit included in the travel control device acquires the limit information which includes a plurality of relative positions up to the front position with the current position as a reference and each speed limit information at the front position indicated by each of the plurality of relative positions as a sequence. The travel curve generation unit included in the travel control device generates the travel curve according to the limit information.

According to a third aspect of the present invention, the limit information acquisition unit included in the travel control device acquires limit information including only the sequence with respect to the representative speed among the sequence of the relative positions from the current position to the front position. The travel curve generation unit included in the travel control device generates the travel curve according to the limit information.

According to a fourth aspect of the present invention, the limit information acquisition unit included in the travel control device acquires the limit information including the relative position from the current position to a deceleration completion position, the speed, and a guaranteed deceleration. The travel curve generation unit included in the travel control device generates the travel curve according to the limit information.

According to a fifth aspect of the present invention, a vehicle includes a vehicle speed limit unit and a travel control device. The vehicle speed limit unit is configured to set a speed limit at each position in order to achieve a predetermined deceleration completion speed at the speed limit start position. The travel control device includes a limit information acquisition unit, a current position acquisition unit, a current speed acquisition unit, travel curve generation unit, and a speed command unit. The limit information acquisition unit is configured to acquire limit information which indicates a plurality of relative positions to the front position with a current position as a reference and each speed limit information at the front position indicated by each of the plurality of relative positions, from the vehicle speed limit unit. The current position acquisition unit is configured to acquire a current position of the vehicle. The current speed acquisition unit is configured to acquire the current speed of the vehicle. The travel curve generation unit is configured to generate a travel curve in which the speed limit at each position obtained from the limit information becomes lower than a predetermined speed, according to the acquired limit information, the current position, and the current speed. The speed command unit is configured to generate a speed command according to the generated travel curve and the current position.

According to a sixth aspect of the present invention, a traffic system includes the vehicle and a ground ATP device. The vehicle includes a vehicle speed limit unit, a limit information acquisition unit, and a travel control device. The travel control device includes a current position acquisition unit, a current speed acquisition unit, a travel curve generation unit, and a speed command unit. The vehicle speed limit unit is configured to set a speed limit at each position in order to achieve a predetermined deceleration completion speed at the speed limit start position. The limit information acquisition unit is configured to acquire limit information which indicates a plurality of relative positions to the front position with a current position as a reference and each speed limit information at the front position indicated by each of the plurality of relative positions, from the vehicle speed limit unit. The current speed acquisition unit is configured to acquire a current speed of the vehicle. The travel curve generation unit is configured to generate a travel curve in which the speed limit at each position obtained from the limit information becomes lower than a predetermined speed, according to the acquired limit information, the current position, and the current speed. The speed command unit is configured to generate a speed command according to the generated travel curve and the current position. The ground ATP device outputs the speed limit start position to the vehicle speed limit unit.

According to a seventh aspect of the present invention, a control method of a travel control device that is mounted on a vehicle and sets a travel speed according to a position of the vehicle and causes the vehicle to travel. The method includes: causing a limit information acquisition unit of the travel control device to acquire limit information which indicates a plurality of relative positions to the front position with a current position as a reference and each speed limit information at the front position indicated by each of the plurality of relative positions, from the vehicle speed limit unit of the travel control device that sets the speed limits at a plurality of positions in order to achieve a predetermined deceleration completion speed at the speed limit start position; causing a current position acquisition unit of the travel control device to acquire a current position of the vehicle; causing a current speed acquisition unit of the travel control device to acquire a current speed of the vehicle; causing a travel curve generation unit of the travel control device to generate a travel curve in which the speed limit at each position obtained from the limit information becomes lower than a predetermined speed, according to the acquired limit information, the current position, and the current speed; and causing a speed command unit of the travel control device to generate a speed command according to the generated travel curve and the current position.

According to an eighth aspect of the present invention, a program causes a computer in a travel control device, which is mounted on a vehicle and sets a travel speed according to a position of the vehicle and causes the vehicle to travel, to function as: limit information acquisition means for acquiring limit information which indicates a plurality of relative positions to the front position with a current position as a reference and each speed limit information at the front position indicated by each of the plurality of relative positions, from the vehicle speed limit unit of the travel control device that sets the speed limits at a plurality of positions in order to achieve a predetermined deceleration completion speed at the speed limit start position; current position acquisition means for acquiring a current position of the vehicle; current speed acquisition means for acquiring a current speed of the vehicle; travel curve generation means for generating a travel curve in which the speed limit at each position obtained from the limit information becomes lower than a predetermined speed, according to the acquired limit information, the current position, and the current speed; and speed command means for generating a speed command according to the generated travel curve and the current position.

Advantageous Effects of the Invention

According to the travel control device, the vehicle, the traffic system, the control method, and the program described above, it is possible to reduce the travelling time of the train with respect to the travelling distance when the automatic driving is performed on the vehicle using the travel control device.

DESCRIPTION OF EMBODIMENTS

Hereinafter, embodiments will be described with reference to the drawings.

First, the first embodiment will be described.

Figure 1:
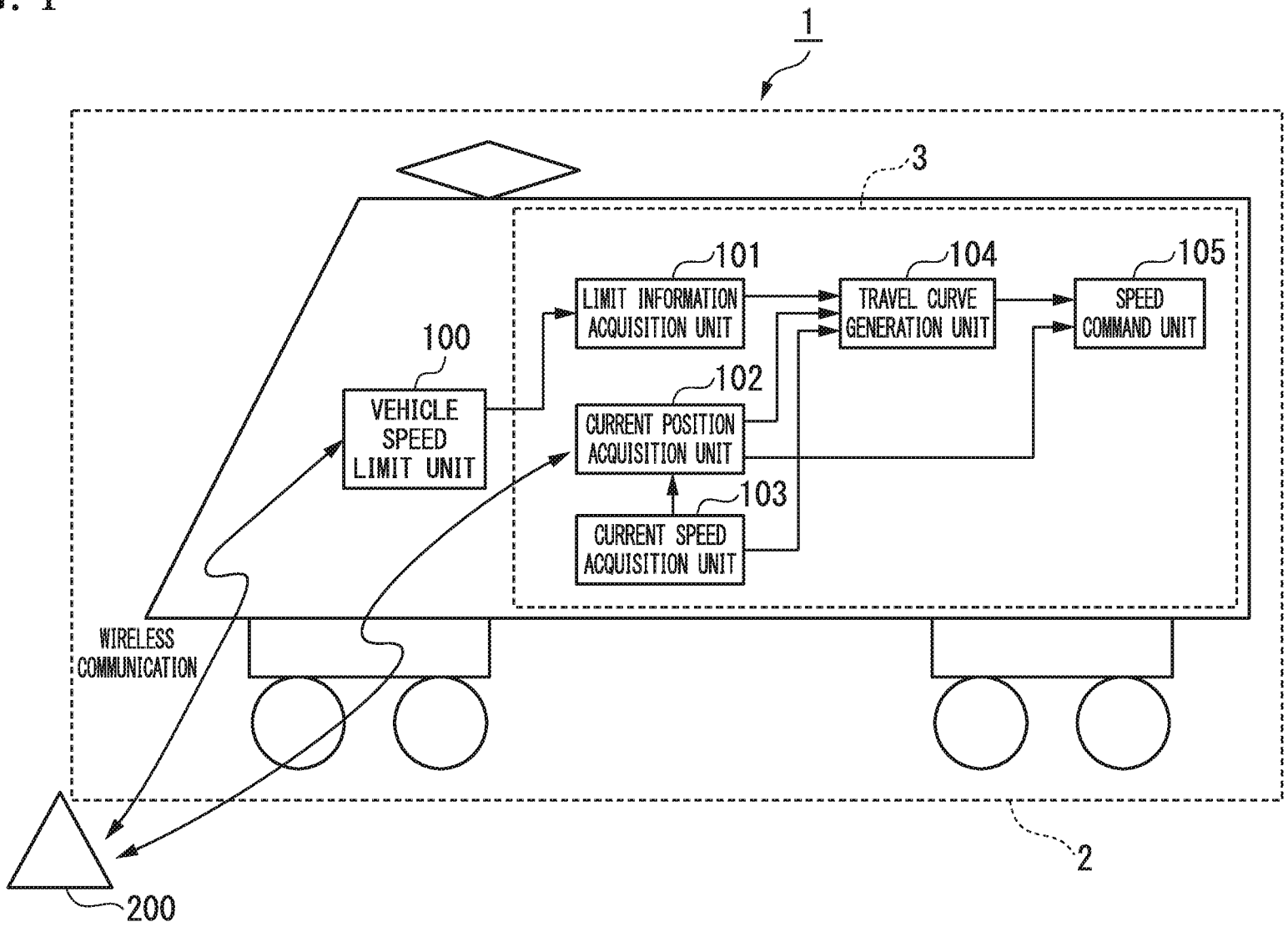
FIG. 1 is a diagram showing an example of a traffic system including a travel control device according to a first embodiment of the present invention.

FIG. 1 is a diagram showing an example of a traffic system 1 including a travel control device 3 according to a first embodiment of the present invention.

As shown in FIG. 1, the traffic system 1 according to the first embodiment includes a vehicle 2 and a ground automatic train protection (ATP) device 200.

The vehicle 2 includes a travel control device 3 according to the first embodiment and a vehicle speed limit unit 100.

The travel control device 3 is an automatic train operation (ATO) device, and includes a limit information acquisition unit 101, a current position acquisition unit 102, a current speed acquisition unit 103, a travel curve generation unit 104, and a speed command unit 105. In addition, the vehicle speed limit unit 100 is an on-vehicle ATP device.

The ground ATP device 200 is provided on the ground and transmits a speed limit start position and limit information to the vehicle speed limit unit 100. The limit information includes speed limit information and position information corresponding to the speed limit.

The vehicle speed limit unit 100 acquires the speed limit start position and the limit information from the ground ATP device 200. In addition, the vehicle speed limit unit 100 acquires a current speed of the vehicle 2 from a speedometer included in the vehicle 2. The vehicle speed limit unit 100 sets a speed limit at each of a plurality of positions according to the acquired speed limit start position in order to achieve a predetermined deceleration completion speed at the speed limit start position. The vehicle speed limit unit 100 outputs the acquired limit information to the limit information acquisition unit 101.

The limit information acquisition unit 101 acquires the limit information which is form from the speed limit information and the position information corresponding to the speed limit from the vehicle speed limit unit 100. The limit information acquisition unit 101 outputs the acquired limit information to the travel curve generation unit 104.

The current speed acquisition unit 103 acquires the current speed of the vehicle 2 from the speedometer included in the vehicle 2. The current speed acquisition unit 103 outputs the acquired current speed to the current position acquisition unit 102 and the travel curve generation unit 104.

The current position acquisition unit 102 acquires the speed limit start position from the ground ATP device 200. The current position acquisition unit 102 calculates a current position according to an accumulation value of the acquired speed limit start position and the current speed input from the current speed acquisition unit 103. The current position acquisition unit 102 outputs the calculated current position to the travel curve generation unit 104 and the speed command unit 105.

The travel curve generation unit 104 generates a travel curve that satisfies the speed limit at each position obtained from the limit information according to the input limit information, the current position, and the current speed. The travel curve is a curve that indicates a relationship between the speed and the distance. The travel curve generation unit 104 outputs the generated travel curve to the speed command unit 105.

The speed command unit 105 generates a speed command according to the input travel curve and the current position. The speed command unit 105 outputs the speed command to a control unit that controls the speed of the vehicle 2.

Figure 2:
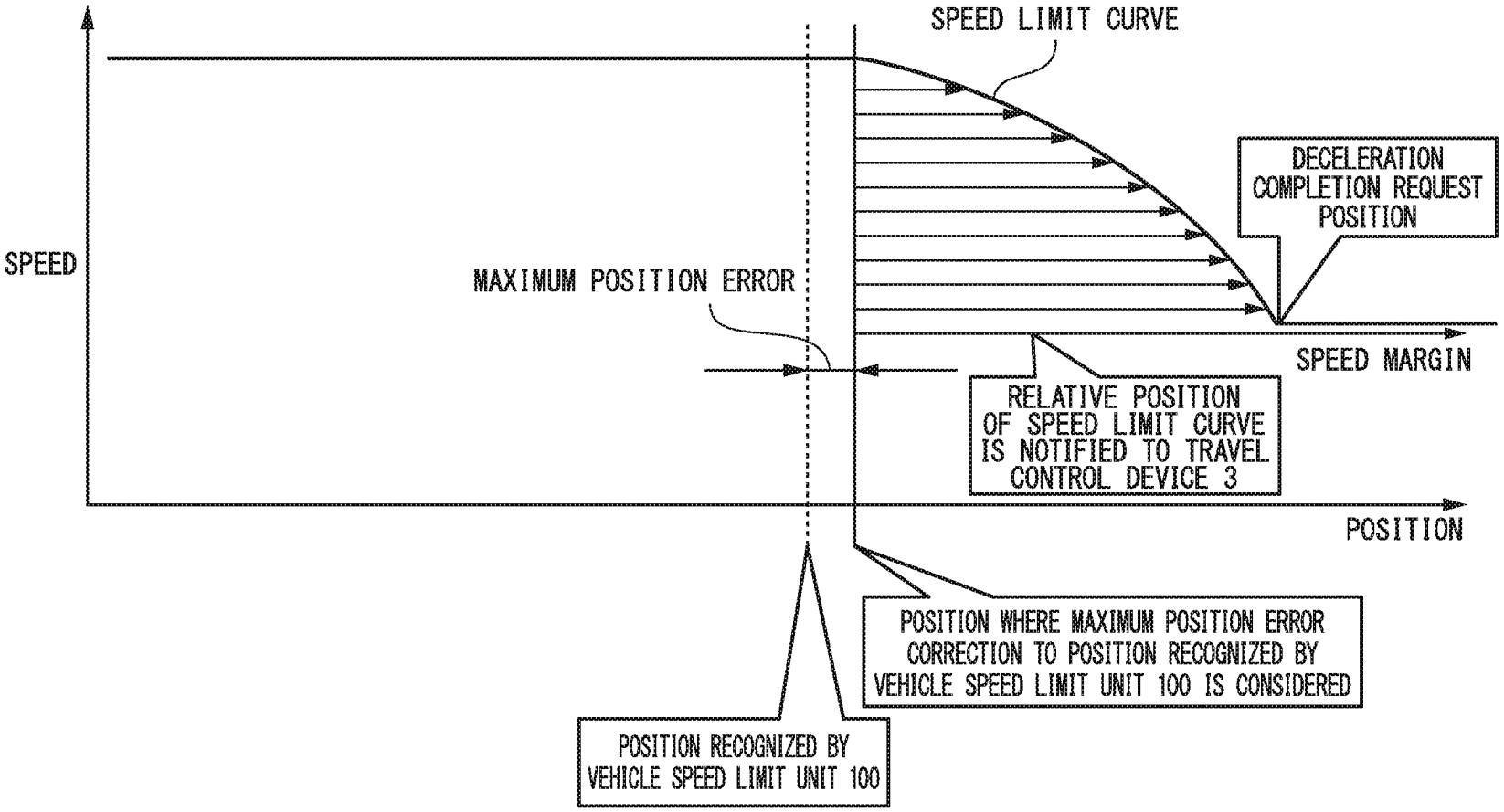
FIG. 2 is a diagram showing an example of limit information acquired by a limit information acquisition unit according to the first embodiment from a vehicle speed limit unit.

FIG. 2 is a diagram showing an example of the limit information acquired by the limit information acquisition unit 101 according to the first embodiment from the vehicle speed limit unit 100.

The vehicle speed limit unit 100 outputs a state of a speed limit curve that indicates the relationship between the speed and the distance represented by the limit information to the limit information acquisition unit 101 as a sequence of the relative positions from the current position. In addition, at this time, the vehicle speed limit unit 100 outputs a position having a margin of maximum position error with respect to the predicted current position to the current position acquisition unit 102 as the current position.

Generally, the speed limit curve is expressed as Equation (1) using an idle running time Td (a time interval from a time when the vehicle speed limit unit 100 recognizes the excessive speed to a time until a brake starts working) and a guaranteed deceleration β in which the deceleration of the train is guaranteed even in a worst situation.

Equation (1)

$$x_{atp}(v) = x_b - \frac{(v^2 - v_b^2)}{2\beta} - vT_d \tag{1}$$

In this Equation (1), a speed limit position $x_{atp}(v)$ with respect to a speed v when a stop position or a speed limit start position $x_b$ and a deceleration completion speed $v_b$ are given, is expressed.

The vehicle speed limit unit 100 sets the speed limit curve according to the speed limit start position acquired from the ground ATP device 200 and Equation (1).

Figure 3:
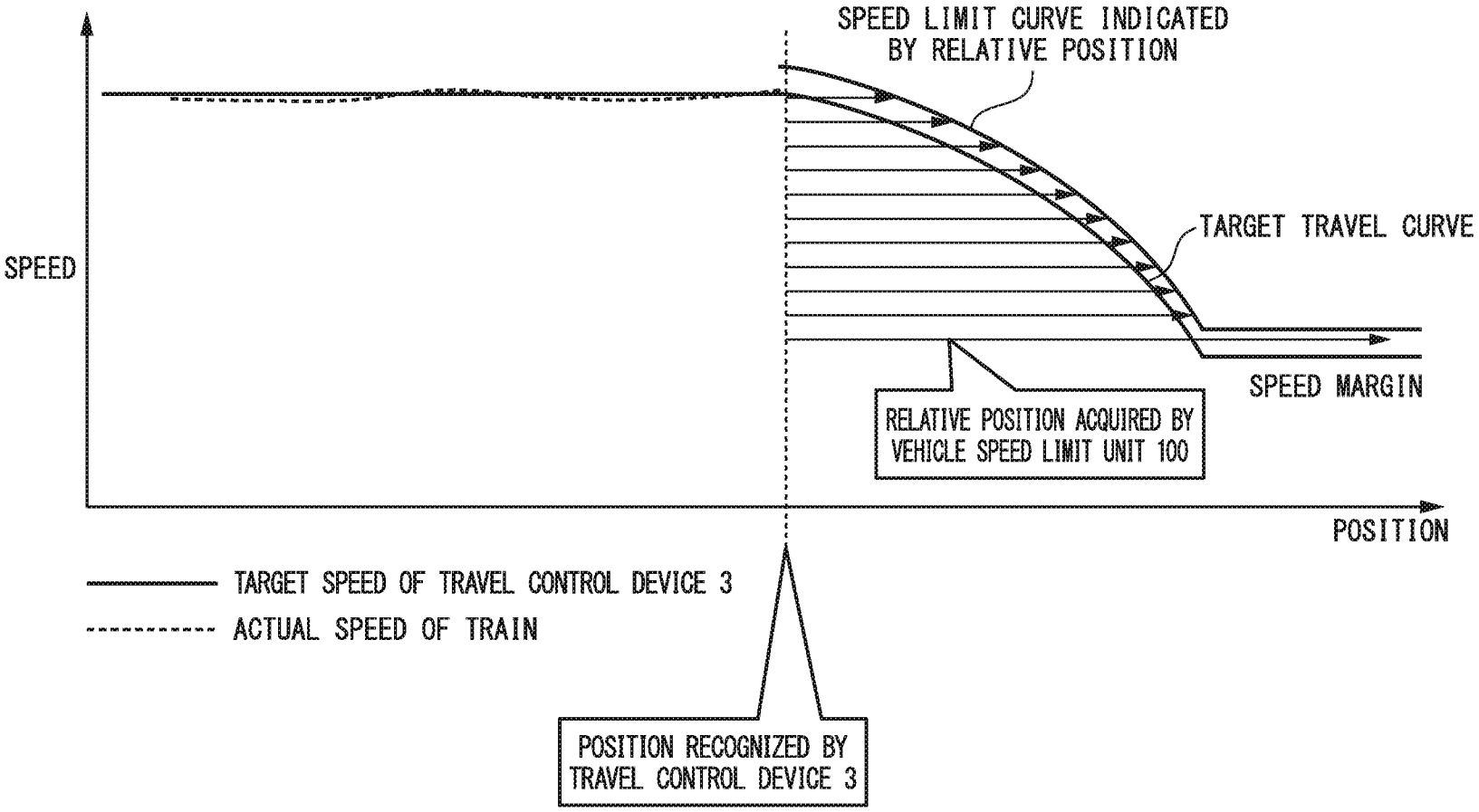
FIG. 3 is a diagram showing an example of a travel curve generated by the travel control device according to the first embodiment.

FIG. 3 is a diagram showing an example of the travel curve generated by the travel control device 3 according to the first embodiment.

The limit information acquisition unit 101 included in the travel control device 3 inputs the limit information including a sequence of the relative positions in which the position having a margin of maximum position error with respect to the current position recognized by the vehicle speed limit unit 100 is set as the current position, from the vehicle speed limit unit 100. The limit information acquisition unit 101 outputs the input limit information to the travel curve generation unit 104.

The travel curve generation unit 104 generates a travel curve that satisfies the speed limit at each position obtained from the limit information according to the limit information acquired from the limit information acquisition unit 101, the current position acquired from the current position acquisition unit 102, and the current speed acquired from the current speed acquisition unit 103.

The vehicle speed limit unit 100 which is an on-vehicle ATP device and the current position acquisition unit 102 included in the ATO device recognize the current position according to the speed limit start position acquired from the same ground ATP device 200. Therefore, the travel curve generation unit 104 may have only the recognition position error caused by a transmission time difference between a signal transmission time from the ground ATP device 200 to the vehicle speed limit unit 100 and a signal transmission time from the ground ATP device 200 to the current position acquisition unit 102 with respect to the current position acquired from the current position acquisition unit 102, as the margin. As a result thereof, the travel curve generation unit 104 has a sum of the recognition position error of the ATP device and the maximum value of the recognition position error caused by the transmission time difference as the margin. Usually, since the recognition position error caused by the transmission time difference is small enough to be almost negligible compared to the recognition position error of the ATP device, the travel curve generation unit 104 can reduce the margin of the recognition position error of the ATO device. The travel curve generation unit 104 inputs the limit information including the sequence of the relative positions with respect to the current position from the limit information acquisition unit 101. In a case where the accuracy of each relative position included in the limit information input from the limit information acquisition unit 101 by the travel curve generation unit 104 is desired to be improved, the travel curve generation unit 104 generates the speed limit curve by performing, for example, a linear interpolation on the values between each sequence. Then, the travel curve generation unit 104 generates a curve having the margin of, for example, five km per hour with respect to the speed limit curve as a target travel curve.

Figure 4:
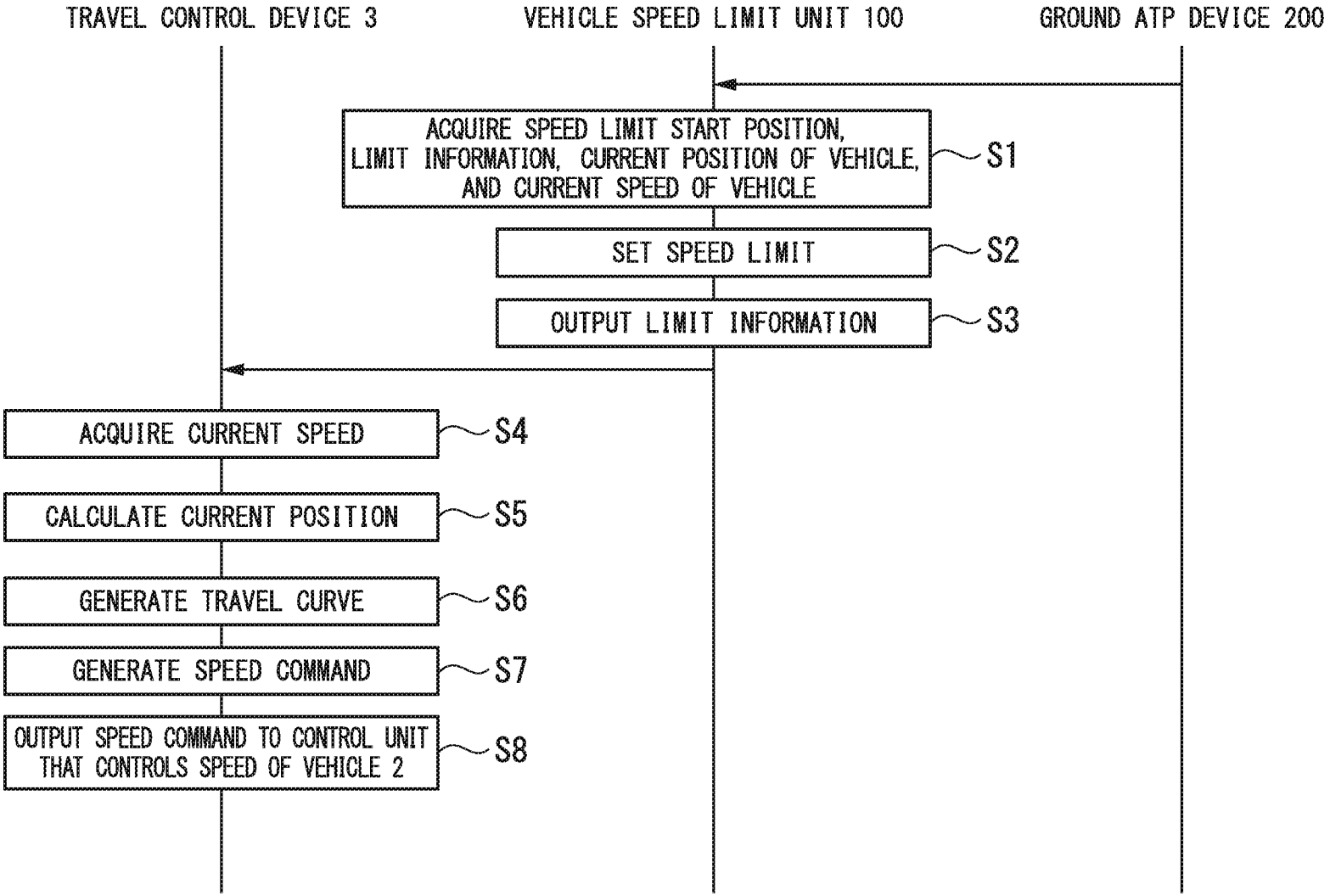
FIG. 4 is a diagram showing an example of a processing flow of the traffic system including the travel control device according to the first embodiment of the present invention.

FIG. 4 is a diagram showing an example of a processing flow of the traffic system 1 including the travel control device 3 according to the first embodiment of the present invention.

Next, the processing by the traffic system 1 including the travel control device 3 according to the first embodiment will be described.

It is assumed that the vehicle 2 included in the traffic system 1 according to the first embodiment travels on a road surface on which a travel condition such as the guaranteed deceleration β in Equation (1) changes for each installation position of the ground ATP device 200. In addition, it is assumed that the vehicle speed limit unit 100 acquires the speed limit start position, the limit information, and the current position of the vehicle 2 from the ground ATP device 200 for each change of the travel condition. In addition, at this time, it is assumed that the current position acquisition unit 102 acquires the speed limit start position from the ground ATP device 200.

In the traffic system 1, during the travelling of the vehicle 2, the vehicle speed limit unit 100 included in the vehicle 2 performs a wireless communication with the ground ATP device 200. Then, the vehicle speed limit unit 100 acquires the speed limit start position, the limit information, the current position of the vehicle 2, and the current speed of the vehicle 2 from the ground ATP device 200 (STEP 51).

The vehicle speed limit unit 100 sets the speed limit at each position according to the speed limit start position acquired from the ground ATP device 200 and Equation (1) in order to achieve a predetermined deceleration completion speed at the speed limit start position, that is, the speed limit curve (STEP S2).

The vehicle speed limit unit 100 outputs the state of the speed limit curve acquired according to the speed limit start position and Equation (1) to the limit information acquisition unit 101 included in the travel control device 3 as the limit information including the sequence of the relative positions from the current position (STEP S3).

When the limit information including the sequence of the relative positions from the current position is input from the vehicle speed limit unit 100, the limit information acquisition unit 101 outputs the input limit information to the travel curve generation unit 104.

In addition, the current speed acquisition unit 103 acquires the current speed of the vehicle 2 from the speedometer included in the vehicle 2 (STEP S4). The current speed acquisition unit 103 outputs the acquired current speed to the current position acquisition unit 102 and the travel curve generation unit 104.

When the current speed is input from the current speed acquisition unit 103, the current position acquisition unit 102 calculates the current position according to the accumulation value of the speed limit start position acquired from the ground ATP device 200 and the input current speed (STEP S5). The current position acquisition unit 102 outputs the calculated current position to the travel curve generation unit 104.

The travel curve generation unit 104 inputs the limit information from the limit information acquisition unit 101. The travel curve generation unit 104 inputs the current speed from the current speed acquisition unit 103. In addition, the travel curve generation unit 104 inputs the current position from the current position acquisition unit 102. Then, the travel curve is generated, which satisfies the speed limit at each position obtained from the limit information according to the input limit information, the current position, and the current speed (STEP S6). For example, as shown in FIG. 3, the travel curve generation unit 104 obtains the current position which is the recognition position by the travel control device 3 according to the current position and the current speed, and obtains the speed limit curve using the current position and the sequence of the relative positions from the current position included in the limit information. Then, the travel curve generation unit 104 generates the target travel curve having the margin of speed limit error with respect to the obtained speed limit curve. The travel curve generation unit 104 generates a curve having the margin of, for example, five km per hour as the target travel curve.

The travel curve generation unit 104 outputs the generated travel curve to the speed command unit 105.

The speed command unit 105 generates the speed command according to the input travel curve and the current position (STEP S7). The speed command unit 105 outputs the speed command to the control unit that controls the speed of the vehicle 2 (STEP S8).

As described above, the processing flow of the traffic system 1 including the travel control device 3 according to the first embodiment of the present invention is described. By the travel control device 3 included in the traffic system 1 described above, the speed limit at each position in order to achieve a predetermined deceleration completion speed at the speed limit start position is set according to the speed limit start position acquired from the ground ATP device 200. The travel control device 3 acquires the limit information including the speed limit information the position information corresponding to the speed limit. The travel control device 3 acquires the current position of the vehicle 2, acquires the current speed of the vehicle 2, and generates the travel curve that satisfies the speed limit at each position obtained from the limit information according to the acquired limit information, the current position, and the current speed. The travel control device 3 generates the speed command according to the generated travel curve and the current position.

In this way, when the vehicle 2 performs the automatic driving using the travel control device 3, it is possible to reduce the travelling time of the train with respect to the travelling distance.

Next, a second embodiment will be described.

Figure 5:
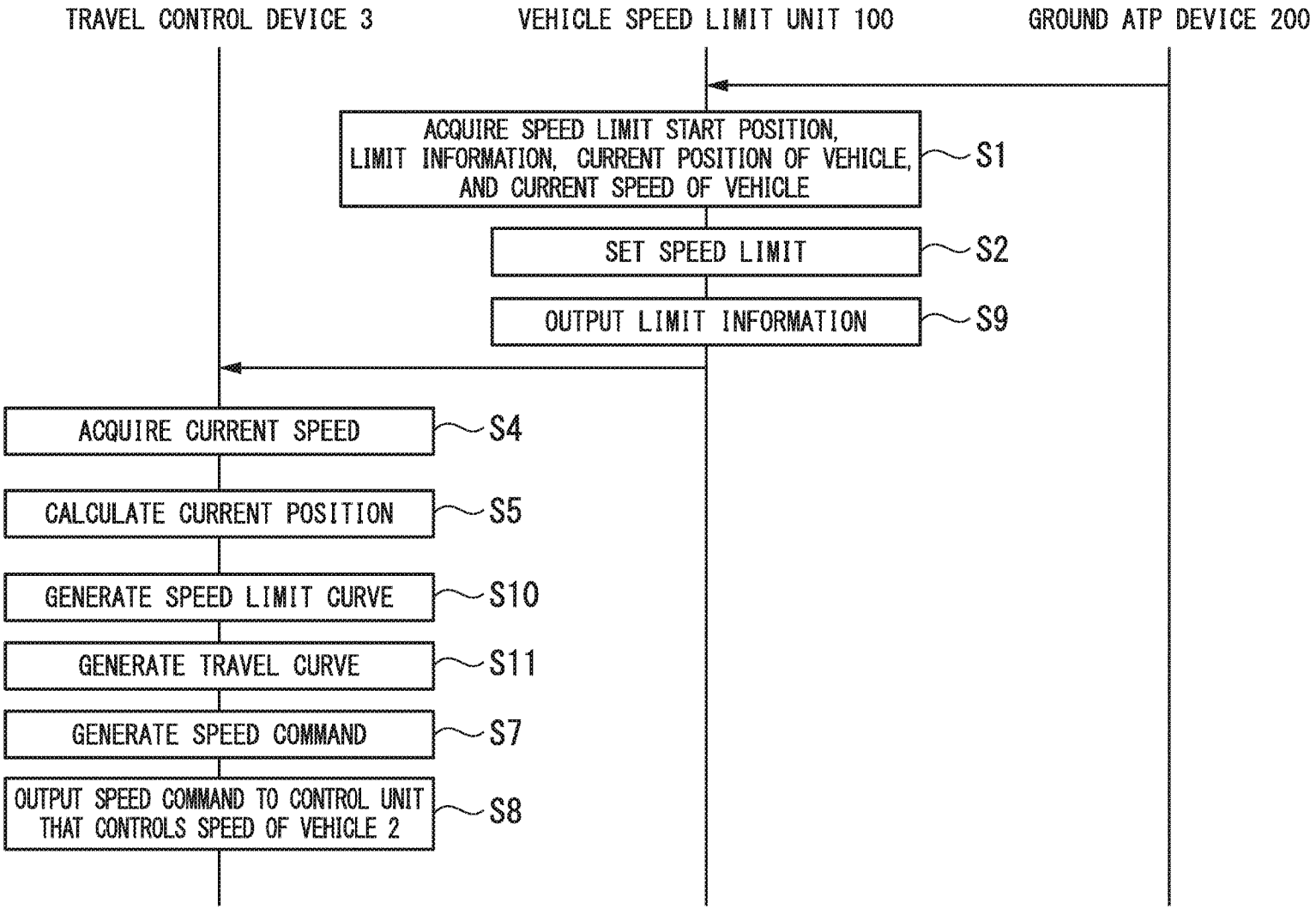
FIG. 5 is a diagram showing an example of a processing flow of the traffic system including a travel control device according to the second embodiment of the present invention.

FIG. 5 is a diagram showing an example of a processing flow of the traffic system 1 including a travel control device 3 according to the second embodiment of the present invention.

Figure 6:
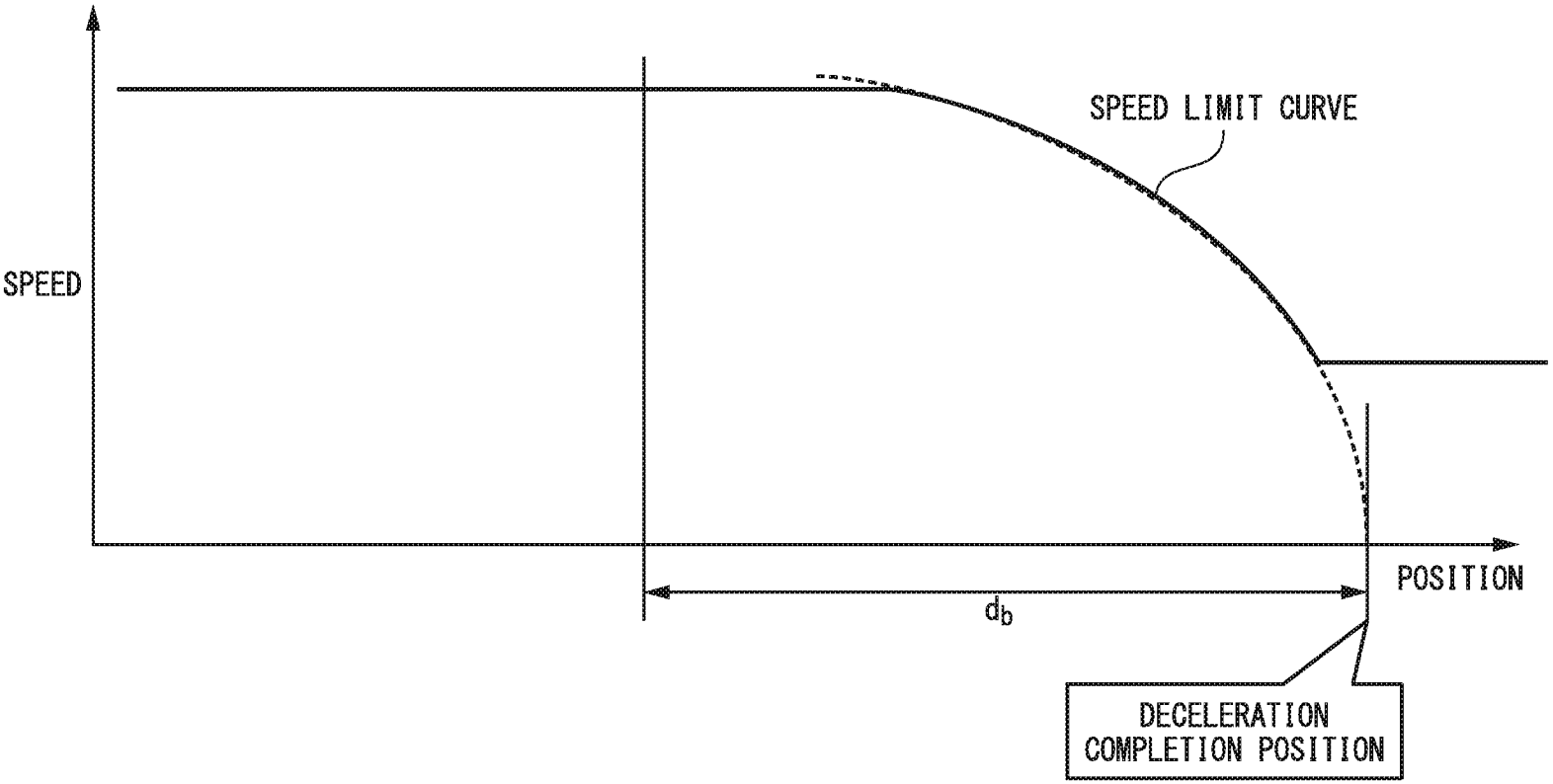
FIG. 6 is a diagram showing an example of a travel curve generated by the travel control device according to the second embodiment of the present invention.

In addition, FIG. 6 is a diagram showing an example of a travel curve generated by the travel control device 3 according to the second embodiment of the present invention.

Next, the processing by the traffic system 1 including the travel control device 3 according to the second embodiment will be described using FIG. 5 and FIG. 6.

It is assumed that the vehicle 2 included in the traffic system 1 according to the second embodiment travels on a road surface on which a gradient or the like changes and a travel condition such as the guaranteed deceleration β expressed in Equation (1) changes. In addition, it is assumed that the travel control device 3 holds Equations (2) to Equation (4) described below.

In addition, here, only processing steps different from that in the first embodiment will be described in detail.

After generating the sequence of the relative positions from the current position by performing the processing items in STEP 51 and STEP S2, similarly to the first embodiment, the vehicle speed limit unit 100 according to the second embodiment outputs limit information including only the sequences corresponding to the representative two speeds among the sequences of the relative positions from the current position to the travel control device 3 (STEP S9). For example, the limit information including a speed $v_1$ in which below the decimal point of the current speed is rounded down, a relative distance $x_1$ from the current position at the speed $v_1$, a speed $v_2$ which is lower than $v_1$ by one km per hour, and a relative distance $x_2$ from the current position at the speed $v_2$, are output to the travel control device 3. Then, the processing items in STEP S4 and STEP S5 are performed.

The limit information acquisition unit 101 included in the travel control device 3 inputs the limit information including only the sequences corresponding the representative two speeds among the sequence of the relative positions from the current position from the vehicle speed limit unit 100. The limit information acquisition unit 101 outputs the limit information input from the vehicle speed limit unit 100 to the travel curve generation unit 104.

The current position acquisition unit 102 inputs the current position from the vehicle speed limit unit 100. The current position acquisition unit 102 outputs the current position input from the vehicle speed limit unit 100 to the travel curve generation unit 104.

The current speed acquisition unit 103 inputs the current speed from the vehicle speed limit unit 100. The current speed acquisition unit 103 outputs the current speed input from the vehicle speed limit unit 100 to the travel curve generation unit 104.

The travel curve generation unit 104 inputs the limit information, the current position, and the current speed from the limit information acquisition unit 101, the current position acquisition unit 102, and the current speed acquisition unit 103 respectively. Then, the travel curve generation unit 104 calculates the guaranteed deceleration β and the relative position $d_b$ of the deceleration completion position by substituting the input limit information into the holding Equation (2) below.

Equation (2)

$$\beta = \frac{-v_1^2 + v_2^2}{2(x_1 - x_2 + (v_1 - v_2)T_d)} \qquad (2)$$

$$d_b = \frac{v_1^2}{2\beta} + v_1 T_d$$

Next, the travel curve generation unit 104 substitutes the current position input from the vehicle speed limit unit 100, the current speed, the calculated guaranteed deceleration β, and the relative position $d_b$ into the holding Equation (3) below. Then, the travel curve generation unit 104 generates the speed limit curve shown in FIG. 6 (STEP S10).

Equation (3)

$$x'_{atp}(v) = x_o + d_b - \frac{v^2}{2\beta} - vT_d \qquad (3)$$

Then, the travel curve generation unit 104 generates Equation (4) below having the margin of, for example, five km per hour as the travel curve with respect to the speed limit curve generated according to Equation (3) (STEP S11). Then, the processing items in STEP S7 and STEP S8 are performed.

Equation (4)

$$x_{atp}(v) = x'_{atp}(v+2) \qquad (4)$$

As described above, the processing flow of the traffic system 1 including the travel control device 3 according to the second embodiment of the present invention is described. By the travel control device 3 included in the traffic system 1 described above, the speed limit at each position in order to achieve a predetermined deceleration completion speed at the speed limit start position is set according to the speed limit start position acquired from the ground ATP device 200. The travel control device 3 acquires the limit information including the two representative speed limit information items and the position information corresponding to the speed limit. The travel control device 3 acquires the current position of the vehicle 2, acquires the current speed of the vehicle 2, and generates the travel curve according to the acquired limit information, the current position, and the current speed. The travel control device 3 generates the speed command according to the generated travel curve and the current position.

In this way, when the vehicle 2 performs the automatic driving using the travel control device 3, it is possible to reduce the travelling time of the train with respect to the travelling distance.

In addition, an amount of information output from the vehicle speed limit unit 100 to the travel control device 3 is reduced, and thus, an amount of communication performed by the travel control device 3 is reduced and a transmission delay is reduced. As a result thereof, it is possible to reduce the manufacturing cost of the travel control device 3.

Next, a third embodiment will be described.

Figure 7:
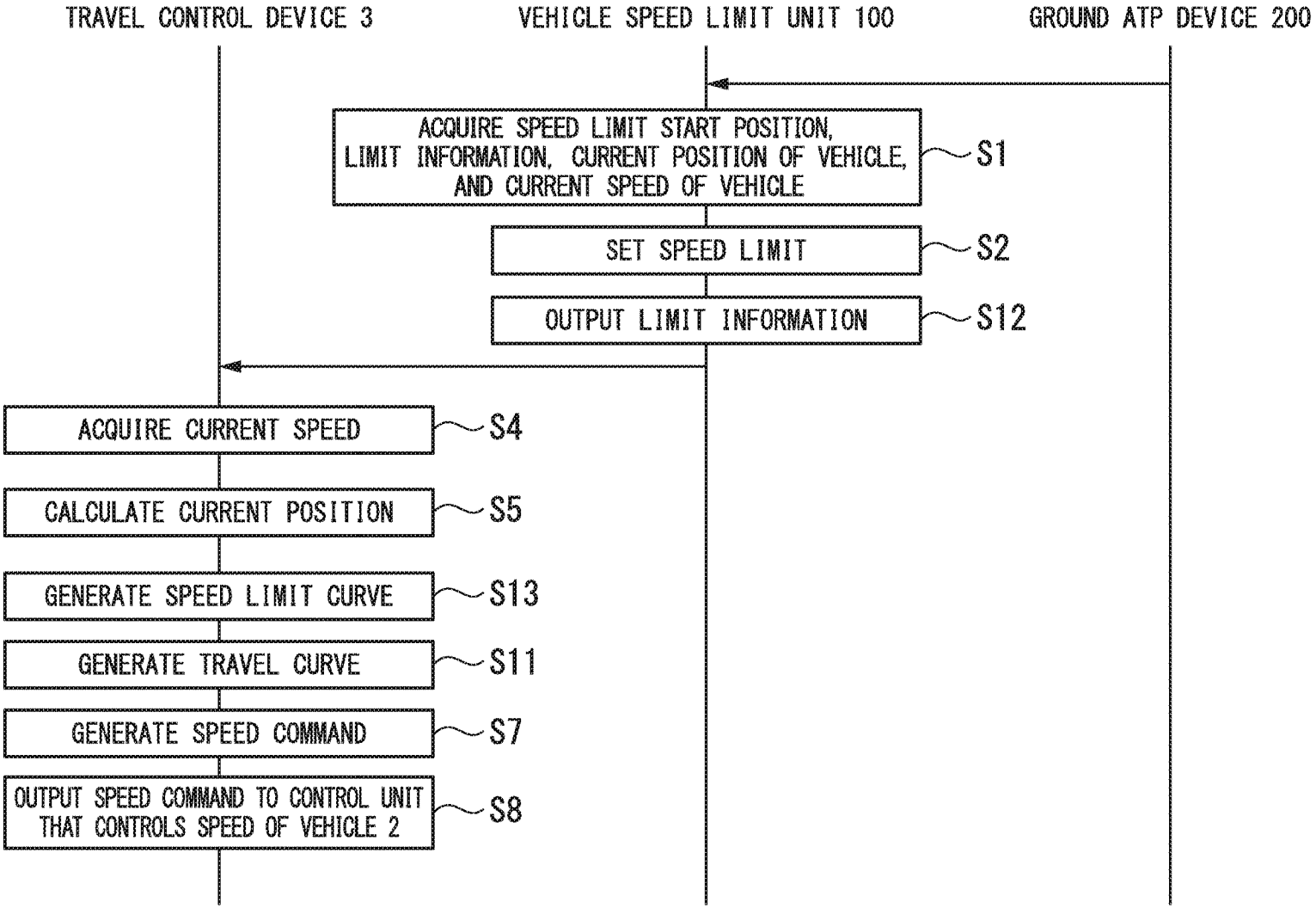
FIG. 7 is a diagram showing an example of a processing flow of the traffic system including a travel control device according to a third embodiment of the present invention.

FIG. 7 is a diagram showing an example of a processing flow of the traffic system 1 including a travel control device 3 according to the third embodiment of the present invention.

Next, the traffic system 1 including the travel control device 3 according to the third embodiment of the present invention will be described.

It is assumed that the vehicle speed limit unit 100 according to the third embodiment sets the speed limit curve according to the speed limit start position acquired from the ground ATP device 200 and Equation (1) in which the guaranteed deceleration β are regarded to be constant. In addition, it is assumed that the travel control device 3 holds Equation (5) expressed below.

Equation (5)

$$x'_{atp}(v) = x_o + d_b - \frac{(v^2 - v_b^2)}{2\beta} - vT_d \qquad (5)$$

The processing items in STEP 51 and STEP S2 are performed. Then, the vehicle speed limit unit 100 outputs the limit information including a relative position db up to the deceleration completion position at which the speed shown in FIG. 6 becomes zero, a speed vb, and the guaranteed deceleration β, to the travel control device 3 (STEP S12).

The limit information acquisition unit 101 included in the travel control device 3 inputs the limit information including the relative position db up to the deceleration completion position, the speed vb, and the guaranteed deceleration β from the vehicle speed limit unit 100. The limit information acquisition unit 101 outputs the limit information input from the vehicle speed limit unit 100 to the travel curve generation unit 104.

The current position acquisition unit 102 inputs the current position from the vehicle speed limit unit 100. The current position acquisition unit 102 outputs the current position input from the vehicle speed limit unit 100 to the travel curve generation unit 104.

The current speed acquisition unit 103 inputs the current speed from the vehicle speed limit unit 100. The current speed acquisition unit 103 outputs the current speed input from the vehicle speed limit unit 100 to the travel curve generation unit 104.

The travel curve generation unit 104 inputs the limit information, the current position, and the current speed from the limit information acquisition unit 101, the current position acquisition unit 102, and the current speed acquisition unit 103 respectively. Then, the travel curve generation unit 104 substitutes the input limit information, the current position, and the current speed into Equation (5) held in the travel control device 3, and generates the speed limit curve (STEP S13). Then, the processing items in STEP S11, STEP S7, and STEP S8 are performed.

In this way, when the vehicle 2 performs the automatic driving using the travel control device 3, it is possible to reduce the travelling time of the train with respect to the travelling distance.

In addition, an amount of information output from the vehicle speed limit unit 100 to the travel control device 3 is reduced, and thus, an amount of communication performed by the travel control device 3 is reduced. As a result thereof, it is possible to reduce the manufacturing cost of the travel control device 3.

When the travel curve generation unit 104 in the second embodiment or in the third embodiment generates the travel curve from the speed limit curve, the travel curve may be generated such that the speed margin increases as the speed of the vehicle 2 increases.

For example, the travel curve generation unit 104 may add a term "−0.2v" that corrects the transmission delay or a term "$-0.01v^2$" that corrects a bad effect of the regenerative brake such as "$x_{ato}(v)=x'_{ato}(v-2)-0.2v-0.01v^2$".

In this way, it is possible to reduce a risk that the brake operates while being closer to the speed limit curve as the travel speed of the vehicle 2 is in the high speed range.

In addition, the control described with respect to the traffic system 1 including the travel control device 3 according to the embodiments of the present invention is not limited to a control of the position up to the deceleration completion request position shown in FIG. 2. The control described with respect to the traffic system 1 including the travel control device 3 according to the embodiments of the present invention can be similarly applied to a deceleration control up to a stop limit (speed limit of the speed 0) of the vehicle 2.

The embodiments of the present invention are described. However, a computer system is included in the travel control device 3, the vehicle speed limit unit 100, and the ground ATP device 200. Then, the processing procedures described above are stored in a computer readable recording medium as a form of a program, and the processing items described above are executed by the computer reading and executing the program. Here, the examples of the computer readable recording medium include a magnetic disk, an optical magnetic disk, a CD-ROM, a DVD-ROM, a semiconductor memory, or the like. In addition, the computer program may be distributed to computers via a communication line and the computer receiving the distribution may execute the program.

In addition, the program described above may be a program for realizing a part of the functions described above. Furthermore, the program described above may be a program that can realize the functions described above by a combination with a program already recorded in a computer system, so-call a differential file (a differential program).

Some of the embodiments of the present invention are described. However, the described embodiments are just provided as examples and do not limit the scope of the invention. In addition, various omissions, substitutions, and modifications can be made without departing from the scope of the invention.

INDUSTRIAL APPLICABILITY

According to the travel control device, the vehicle, the traffic system, the control method, and the program described above, when the automatic driving is performed on the vehicle, it is possible to reduce the travelling time of the train with respect to the travelling distance.

REFERENCE SIGNS LIST

1 traffic system
2 vehicle
3 travel control device
100 vehicle speed limit unit
101 limit information acquisition unit
102 current position acquisition unit
103 current speed acquisition unit
104 travel curve generation unit
105 speed command unit
200 ground ATP device

The invention claimed is:

1. A traffic system, comprising:

a ground automatic train protection (ATP) device installed on a ground, an on-vehicle ATP device that is mounted on a vehicle, and a travel control device that is mounted on the vehicle, wherein the ground ATP device is configured to transmit a speed limit start position to the on-vehicle ATP device, wherein the on-vehicle ATP device is configured to output limit information, based on the speed limit start position acquired from the ground ATP device, and a predetermined deceleration completion speed to be achieved at the speed limit start position, wherein the limit information corresponds to a speed limit curve indicating positions of the vehicle at future times, and corresponding speed limits at the positions of the vehicle at the future times, wherein the positions of the vehicle at the future times are relative positions with respect to a reference position, wherein the reference position is based on a margin of maximum position error, and a current position of the vehicle as recognized by the on-vehicle ATP device, wherein the travel control device is configured to:

acquire the limit information from the on-vehicle ATP device, acquire a current speed of the vehicle, acquire a current position of the vehicle as recognized by the travel control device, based on
the speed limit start position, and
the current speed of the vehicle, generate a travel curve, based on the limit information, the current position of the vehicle as recognized by the travel control device, and the current speed, wherein the travel curve indicates
the positions of the vehicle at the future times, and
corresponding target speeds at the positions of the vehicle at the future times, wherein the target speeds do not exceed the speed limits at the corresponding positions of the vehicle at the future times, and generate a speed command according to the travel curve and the current position as recognized by the travel control device.

2. The traffic system according to claim 1, wherein the limit information includes a sequence of each of the positions of the vehicle at the future times and a corresponding speed limit at said each of the positions of the vehicle at the future times.

3. The traffic system according to claim 1, wherein the limit information includes only two representative speeds and two corresponding positions of the vehicle at two future times.

4. The traffic system according to claim 1, wherein the speed limit curve is expressed as:

$$x_{atp}(v) = x_b - \frac{(v^2 - v_b^2)}{2\beta} - vT_d$$

where $x_{atp}(v)$ is a speed limit position corresponding to a speed v, $x_b$ is the speed limit start position corresponding to the deceleration completion speed $v_b$, β is a guaranteed deceleration, and $T_d$ is an idle running time.

5. A control method of a traffic system comprising a ground automatic train protection (ATP) device installed on a ground, an on-vehicle ATP device mounted on a vehicle, and a travel control device mounted on the vehicle, the method comprising:

causing the ground ATP device to transmit a speed limit start position to the on-vehicle ATP device;

causing the on-vehicle ATP device to output limit information, based on
the speed limit start position acquired from the ground ATP device, and
a predetermined deceleration completion speed to be achieved at the speed limit start position,
wherein the limit information corresponds to a speed limit curve indicating
positions of the vehicle at future times, and
corresponding speed limits at the positions of the vehicle at the future times,
wherein the positions of the vehicle at the future times are relative positions with respect to a reference position,
wherein the reference position is based on
a margin of maximum position error, and
a current position of the vehicle as recognized by the on-vehicle ATP device;

causing the travel control device to acquire the limit information from the on-vehicle ATP device;

causing the travel control device to acquire a current speed of the vehicle;

causing the travel control device to acquire a current position of the vehicle as recognized by the travel control device, based on
the speed limit start position, and
the current speed of the vehicle;

causing the travel control device to generate a travel curve, based on the limit information, the current position of the vehicle as recognized by the travel control device, and the current speed, wherein the travel curve indicates
the positions of the vehicle at the future times, and
corresponding target speeds at the positions of the vehicle at the future times, wherein the target speeds do not exceed the speed limits at the corresponding positions of the vehicle at the future times; and causing the travel control device to generate a speed command according to the travel curve and the current position as recognized by the travel control device.

6. A non-transitory storage medium that stores a program for causing a computer in a traffic system comprising a ground automatic train protection (ATP) device installed on a ground, an on-vehicle ATP device mounted on a vehicle, and a travel control device mounted on the vehicle, to perform:

causing the ground ATP device to transmit a speed limit start position to the on-vehicle ATP device;

causing the on-vehicle ATP device to output limit information, based on
the speed limit start position acquired from the ground ATP device, and
a predetermined deceleration completion speed to be achieved at the speed limit start position,
wherein the limit information corresponds to a speed limit curve indicating
positions of the vehicle at future times, and
corresponding speed limits at the positions of the vehicle at the future times
wherein the positions of the vehicle at the future times are relative positions with respect to a reference position,
wherein the reference position is based on
a margin of maximum position error, and
a current position of the vehicle as recognized by the on-vehicle ATP device;

causing the travel control device to acquire the limit information from the on-vehicle ATP device;

causing the travel control device to acquire a current speed of the vehicle;

causing the travel control device to acquire a current position of the vehicle as recognized by the travel control device, based on
the speed limit start position, and
the current speed of the vehicle;

causing the travel control device to generate a travel curve, based on the limit information, the current position of the vehicle as recognized by the travel control device, and the current speed, wherein the travel curve indicates
the positions of the vehicle at the future times, and
corresponding target speeds at the positions of the vehicle at the future times, wherein the target speeds do not exceed the speed limits at the corresponding positions of the vehicle at the future times; and causing the travel control device to generate a speed command according to the travel curve and the current position as recognized by the travel control device.

* * * * *